United States Patent [19]

Jamison

[11] Patent Number: 4,803,493

[45] Date of Patent: Feb. 7, 1989

[54] MOBILE ANTENNA CIRCUIT WITH VARIABLE LINE LENGTH

[76] Inventor: Wayne L. Jamison, P.O. Box 75144, Houston, Tex. 77234

[21] Appl. No.: 936,354

[22] Filed: Dec. 1, 1986

[51] Int. Cl.[4] ..... H01Q 1/10; H01Q 3/22

[52] U.S. Cl. ..... 343/745; 343/715; 343/723; 343/861; 343/901

[58] Field of Search ..... 343/703, 712, 713, 714, 343/715, 723, 745, 750, 823, 861, 883, 900, 901

[56] References Cited

U.S. PATENT DOCUMENTS

| | | | |
|---|---|---|---|
| 2,719,920 | 10/1955 | Ellis | 343/745 |
| 2,855,599 | 10/1958 | Kandoian | 343/861 |
| 3,381,222 | 4/1968 | Gray | 343/703 |
| 3,671,932 | 6/1972 | Spilsbury et al. | 343/703 |
| 3,909,830 | 9/1975 | Campbell | 343/712 |
| 4,506,266 | 3/1985 | Mizuno et al. | 343/715 |

FOREIGN PATENT DOCUMENTS

| | | | |
|---|---|---|---|
| 0186101 | 9/1985 | Japan | 343/713 |

*Primary Examiner*—William L. Sikes

*Assistant Examiner*—Doris J. Johnson

*Attorney, Agent, or Firm*—Bill B. Berryhill

[57] ABSTRACT

A mobile antenna circuit for resonant transmitting from an RF signal source may comprise: an antenna having a base and at least first and second conductive sections one of which is extendable and retractable to lengthen and shorten the antenna; a motor operatively connected to one of the conductive sections for extending and retracting the antenna in response to control signals thereto; an impedance matching circuit coupling the RF signal source to the base of the antenna for matching impedance thereof at a specified frequency; and control components connected to the motor to produce control signals for extending and retracting the antenna section so as to resonantly tune the antenna at a specified frequency. The circuit may include a phase angle detector connected between the RF signal source and the impedance matching circuit for developing a voltage differential being fed to the control components for producing the control signals for extending and retracting the antenna section.

12 Claims, 4 Drawing Sheets

MOBILE ANTENNA CIRCUIT WITH VARIABLE LINE LENGTH

BACKGROUND OF THE INVENTION

1. Field of the Invention

The present invention pertains to antennas and antenna circuits for transmission of RF (radio frequency) signals. More specifically, the invention pertains to a mobile antenna and antenna circuit for automatically resonantly tuning the antenna circuit at a specified frequency.

2. Description of the Prior Art

The strength of an electromagnetic field radiating from a section of wire carrying radio frequency current depends, among other things, on the amount of current flowing therein. Other things being equal, the field strength is directly proportional to the flowing current. Generally speaking, it is desirable to make the current flowing as large as possible. An RF antenna circuit contains an inductor and a capacitor in series. Resonance is a special case in a series circuit containing both inductance (L) and capacitance (C) in which its inductive reactance ($X_L$) and its capacitive reactance ($X_C$) are equal. It is well known that power radiated by an antenna operated at resonance is substantially increased over one not operated a resonance. Receptivity of a resonant antenna in receiving radio energy is also increased. Thus, resonance is desirable in an antenna circuit.

Broadcasting stations induce in the antenna circuit emf's of frequencies equal to the carrier frequencies of the stations. When the circuit is tuned so that the circuit is in resonance with the frequency of any desired station, the current corresponding to that particular frequency is large, and a large potential appears across its capacitor. But since at any one setting the circuit is in resonance for one frequency only, other stations will develop only negligibly small currents and potential differences and hence will not be heard.

Especially in mobile systems, it is often necessary to provide a single antenna, usually of fixed small physical length which is capable of satisfactory operation over a broad band of frequencies. The antenna operates in such a manner that its impedance match with a transmission line at each of the frequencies satisfactory for operability. This type of operation is most often used in aircraft, automobiles, trucks, small boats or other moving vehicles, where for reasons of economy of space and weight, a single antenna system must be used.

In many instances these antennas of fixed length have a maximum dimension which is small compared to the operating wave length and have impedance characteristics which vary rapidly with frequency. Good operation is normally only achieved over a relatively narrow range of frequencies, if fixed matching networks and tuning elements are used. For use over a range of frequencies, these antennas require retuning of the matching circuit of the antenna system as the frequency of operation is changed.

The advantages of being able to quickly and exactly resonate an antenna to any frequency over a certain range has long been recognized. This is particulary true of mobile operation which incurs constant change of environment resulting in continual changes in the resonant characteristics of the antenna and antenna circuit. Thus, many attempts have been made to provide an easily and quickly resonating system. U.S. Pat. Nos. 2,810,070 and 2,855,599 disclose circuits utilizing automatic antenna tuners designed for this purpose. In U.S. Pat. No. 3,381,222 the movement of a loading coil in an antenna to place the antenna in resonance with the RF signal is controlled by a logic circuit automatically responsive to signals from a resonance detector unit. The loading coil inductance is changed by moving a ferite slug into the center of the coil. However, ferite coil inductors are very inefficient at high power levels. U.S. Pat. No. 3,475,703 discloses an automatically controlled antenna tuning system which utilizes a phase discriminator or detector for developing a signal to control resonance. However, the control circuitry is elaborate and the power handling capability is limited through the use of a variable capacitor or variable inductor.

SUMMARY OF THE PRESENT INVENTION

The present invention provides a mobile antenna circuit for resonant transmitting from an RF signal source which comprises: an antenna having a base and at least first and second conductive sections one of which is extendable and retractable to lengthen and shorten the antenna; a motor operatively connected to one of the conductive sections for extending and retracting the antenna in response to control signals thereto; an impedance matching circuit coupling the Rf signal source to the base of the antenna for matching impedance thereof at a specified band of frequencies and control components connected to the motor to produce control signals for extending and retracting the antenna section so as to resonantly tune the antenna at a specified frequency. The circuit may include a phase angle detector connected between the RF signal source and the impedance matching circuit for developing a voltage differential being fed to the control components for producing the control signals for extending and retracting the antenna section.

As indicated, the antenna has first and second sections, one of which is telescopically extendable and retractable within the other to effect lengthening and shortening of the antenna. The movable antenna section is operatively connected to the motor by a rod of nonconductive material passing through a hollow core of the coil section, the rod being axially movable within the core in response to control signals to effect the lengthening and shortening of the antenna.

Thus, the antenna and antenna circuit of the present invention do not utilize a tuning device or an antenna tuner to resonantly tune the antenna. The tuning element is actually a radiating part of the antenna. Tuning the antenna, rather than the antenna tuner, eliminates added radiation losses in the feed line. The automatic resonating antenna of the present invention allows a skilled or unskilled radio operator to operate within a wide band of frequencies with the efficiency of an antenna tuned to a single frequency. Many other objects and advantages of the invention will be apparent from reading the description which follows in conjunction with the accompanying drawings.

DESCRIPTION OF THE PREFERRED EMBODIMENT

Figures 1, 2:
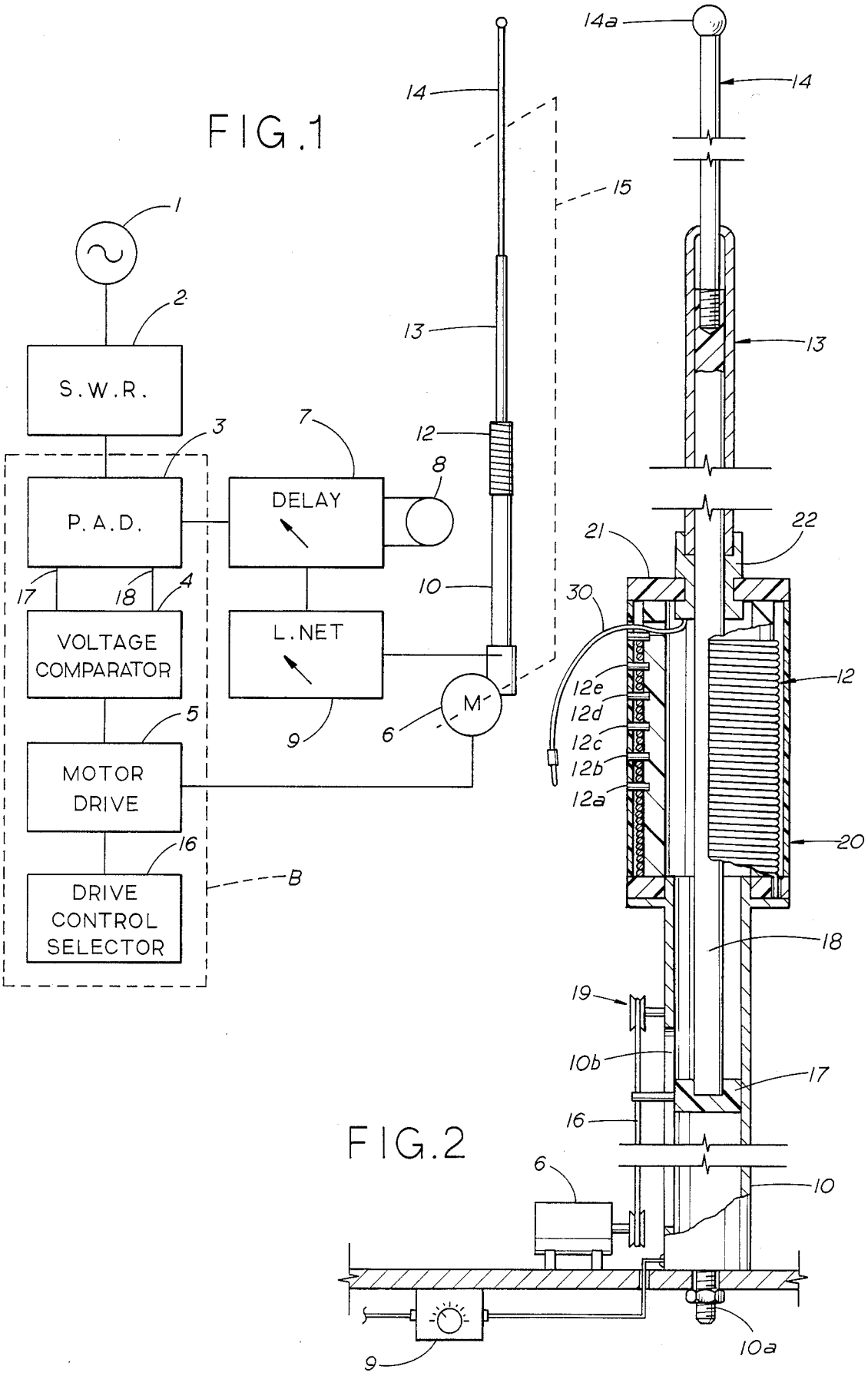
FIG. 1 is a block diagram of the mobile antenna system of the present invention.
FIG. 2 is a pictorial representation of the antenna element of the present invention.

Referring first to FIG. 1, there is shown an RF signal source 1 connected via coaxial cable to the base 10 of an antenna through a standing wave ratio (SWR) meter 2, a phase angle detector (PAD) 3, a feed line selector 7 and an impedance matching L network 9. The antenna base 10 is a conductive section of an antenna which also includes a conductive coil section 12 above which are disposed first and second antenna sections 14 and 13 one of which (14 in this case) is telescopically extendable and retractable with the other to effect lengthening and shortening to the antenna element. A motor 6 is operatively connected, as indicated at 15, to the upper section 14 for lengthening and shortening of the antenna. Connected to the phase angle detector (PAD) 3, is a voltage comparator 4, a motor drive 5, and a drive control selector 16. These components may be mounted in a box B. The motor drive 5 is connected to the motor 6.

Referring to FIG. 2, the antenna is shown in greater detail. As previously mentioned, it includes a conductive base section 10 provided with a bolt or other connection means **10*a* for connecting or mounting the antenna on a mobile vehicle, such as an automobile. The base section 10 may be made of one inch copper pipe with a longitudinal slot 10*b* cut therein to accomodate a coupling device. Attached to the base section 10 is a conductive coil section 12. The coil section 12 is a 75 meter coil wound on one inch Lexan tubing and tapped at 12*a*, 12*b*, 12*c*, 12*d* and 12*e* for 40, 20, 15, 12 and 10 meter bands, respectively. The coil 12 may be covered by Lexan tubing 20 which is closed at both ends by nylon end caps 21**.

Figure 8:
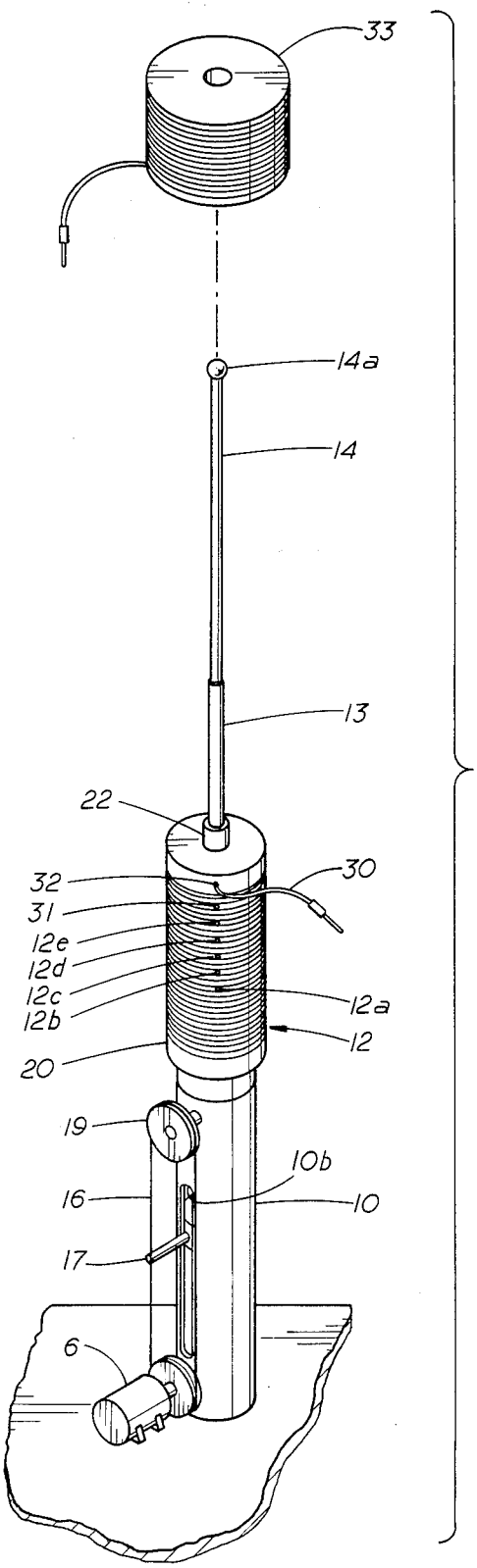
FIG. 8 is a pictorial representation of an antenna element, according to an alternate embodiment of the invention.

An alternate embodiment of the antenna is shown in FIG. 8 which is capable of 160 meter band operation. In this embodiment, the top of the coil section 12 is separated from the bottom of section 13. However, they may be connected by a short jumper 30 through jacks 31 and 32. When so connected the antenna of FIG. 8 operates the same as the antenna in FIG. 2. To operate at 160 meters, the jumper 30 is removed and an additional or add-on coil 33 is placed at the top of tubing 20. The coil 33 is connected to the plugs 31 and 32 and is thus added to the 75 meter coil section 12 to provide 160 meter band operation.

Attached above the coil 12 by a tube fitting 22 is an antenna section 13 which may be made of $\frac{3}{8}$ inch stainless steel tubing. Another antenna section 14, preferrably of stainless steel with an anti-corona ball **14*a* on the top thereof is telescopically extendable and retractable within the tube section 13. Attached to the lower end of the antenna section 14 is a long $\frac{1}{4}$ inch Teflon rod 18 which extends through section 13 through coil 12 and partially into the base section 10. This Teflon rod 18 is secured to a nylon guide piece 17 which is adapted for sliding up and down within the slot 10*b* of the base section 10. The guide piece 17 is in turn attached to a stainless steel cable 16 which runs over a nylon idler pulley 19 attached to the base section 10 and to a pulley attached to the motor 6. Thus it can be seen that rotation of the motor 6 causes the pulley 16 to move upwardly or downwardly with the guide piece 17. This in turn causes the Teflon rod 18 and the attached upper antenna section 14 to be retracted or extended, depending upon the direction of the rotation of the motor 6**. In an exemplary embodiment, the overall length of the antenna can thus be made vary from 7 to $8\frac{1}{2}$ feet.

To explain operation of the antenna system of FIG. 1, it will be assumed that an RF current passes through the phase angle detector (PAD) 3. If the antenna is resonant at the operating frequency, there will be no voltage difference between points 17 and 18 of the phase angle detector 3 (see $F_R$ in FIG. 3). This condition has the motor drive 5 and thus the motor 6 turned off, providing that drive control selector 16 is set properly.

Figure 3:
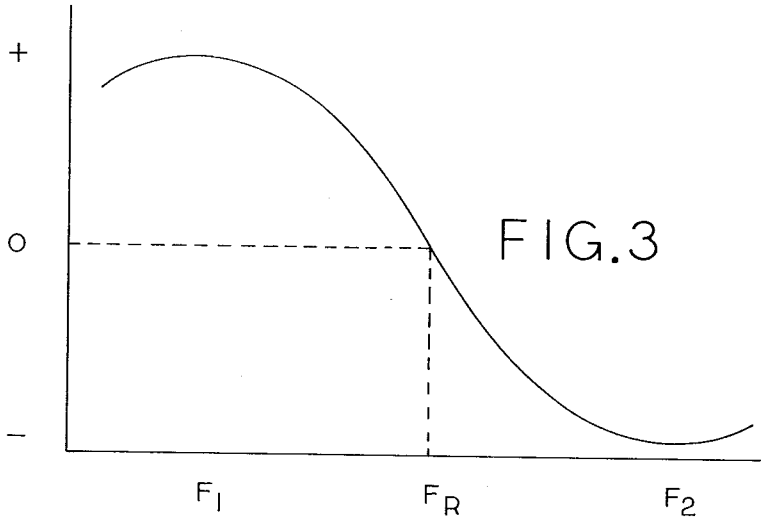
FIGS. 3–6 are graphs representing voltage across a phase angle detector utilized in the mobile antenna circuit of the present invention.

If the operating frequency is below the resonant frequency of the antenna, within the bounds of $F_1$ (FIG. 3), the motor 5 will run and lengthen the antenna until it resonates ($F_R$ in FIG. 3). If the operating frequency is above the resonant frequency of the antenna, within the bounds of $F_2$ (see FIG. 3), the motor 5 will run and shorten the antenna until it resonates ($F_R$ in FIG. 3).

Figure 4:
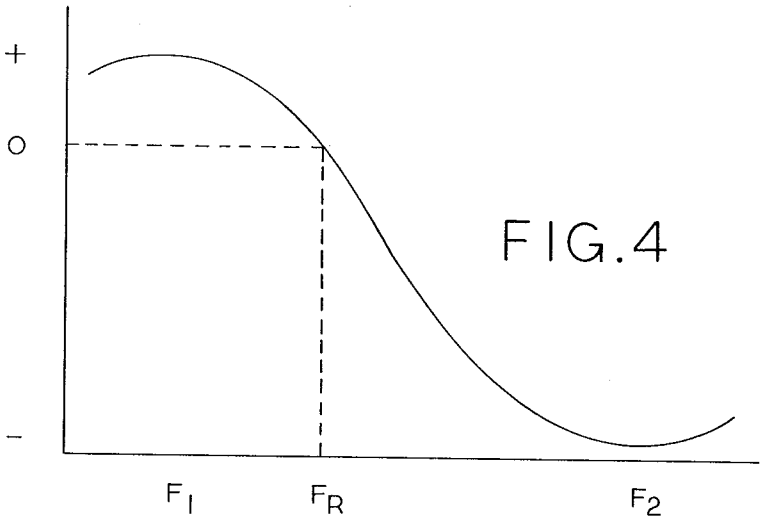
Figure 5:
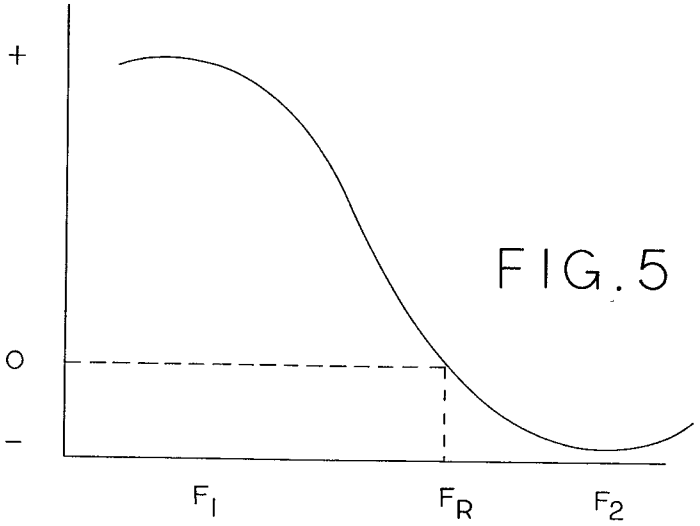
Figure 6:
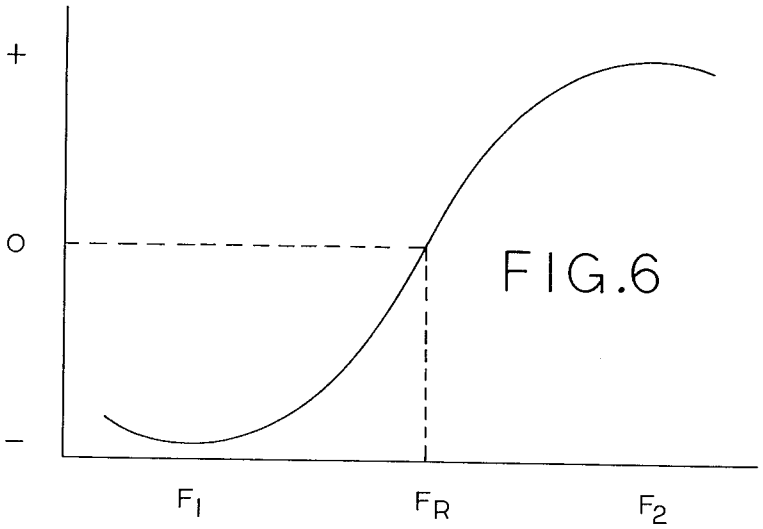

The mobile antenna of the present invention is set up prior to operation into bands of frequency. In the preferred embodiment 75, 40, 20, 15, 12 and 10 meter amateur radio bands are provided for. The alternate embodiment of FIG. 8 includes 160 meter band. Of course, other commercial, marine, military and government bands could also be provided. To set up the antenna for a particular band, the loading coil 12 is physically tapped with one of the taps **12*a*, 12*b*, 12*c*, 12*d* and 12*e* (see FIG. 2). A physically tapped coil is used instead of a switching arrangement so as not to limit the power handling capability and to maintain high Q (quality factor). Once the particular band is selected, the L matching network 9 is switched for the appropriate band. A selected amount of feed line 8 is placed in the circuit by the feed line selection box 7. This is necessary so that the voltage comparator 4 will see a symmetrical S-curve (see FIGS. 3, 4 and 5). The impedance matching circuit or network 9** creates a shift between RF line voltage and RF line current determined by the following formula:

$$\cos\beta = \sqrt{\frac{Z_2}{Z_1}}$$

where:

$\beta$ = phase shift (degrees)

$Z_1$ = impedance of RF signal source (ohms)

$Z_2$ = impedance of antenna (ohms).

To produce a symmetrical S-curve the feed line selector 7 is set to add a length of feed line 8 between the phase angle detector and antenna base 10 determined by the following formula:

$$L = \frac{L_f \times (90^\circ - \beta)}{360^\circ} + X\frac{L_f}{4}$$

where:

L = length of feed line $L_f$ = one wave length of feed line for specific frequency f $L_f/4$ = one quarter wave length of feed line for a specified frequency f $\beta$=phase shift created by L network (degrees)

X=any whole number (or zero).

One wave length of feed line ($L_f$) is determined by the following formula:

$$L_f = \frac{984 \times V_f}{f}$$

where:

$V_f$=velocity factor of the feed line f=specified frequency (megahertz)

The drive control selector 16 may be provided with three switches: on/off, auto/manual and up/down. These switches must be placed in the proper position for a particular band. When the operating frequency is out of the pass band of the curve, the automatic resonating circuitry will not operate properly because the motor will run in the opposite direction. This will move the upper section 14 to its limit one way or the other. The drive cable will slip on its pulley until the motor is manually turned off.

Figure 7:
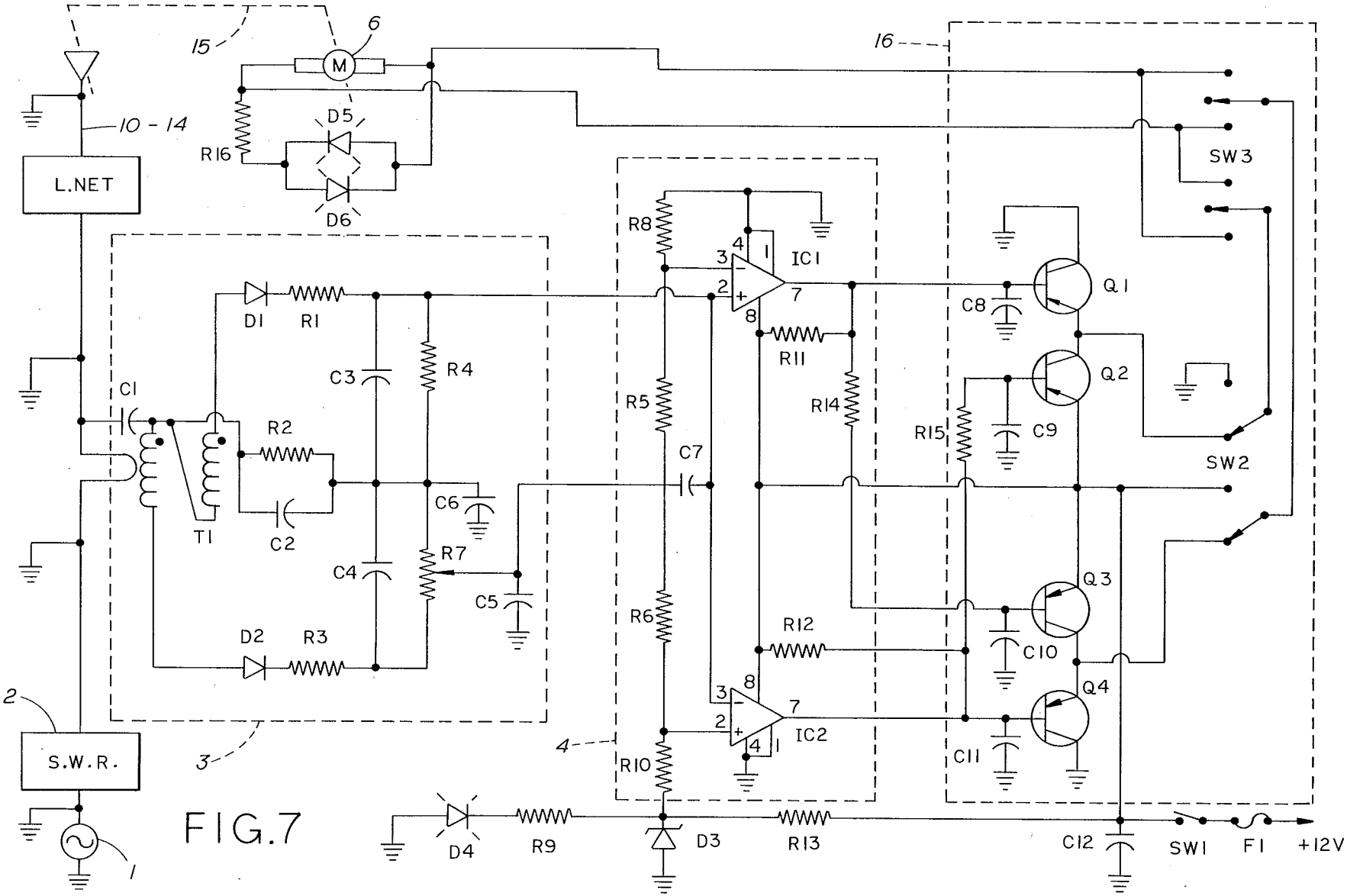
FIG. 7 is a schematic diagram of the mobile antenna circuit of the present invention.

FIG. 7 is an electrical circuit diagram of the mobile antenna circuit of FIG. 1 in the present invention. Some of the electrical components thereof are as follows:

| | |
|---|---|
| | Resistors: |
| R 1 & 3 | 27 ohm ⅛ watt |
| R 2 | 22k |
| R 4 | 470k |
| R 5 & 6 | 220 |
| R 8 | 5.6k |
| R 9 | 150 |
| R 10 | 2.7k |
| R 11 & 12 | 10k |
| R 14 & 15 | 1k |
| R 16 | 470 |
| R 13 | 270 ohm ¼ watt |
| R 7 | 1 meg. pot. |
| | Capacitors: |
| C 1 | 7 pfd. |
| C 2 | 100 pfd. |
| C 3–7 | .001 mfd. disk |
| C 8–12 | .01 mfd. |
| | Diodes: |
| D 1 & 2 | SK 9000 600 V 1 amp. - high pwr. low pwr. 1N914 without R1 & 3 |
| D 3 | 9.1 V Zener 1 watt |
| D 4 | Led (pwr. on-red) |
| D 5 | Led (up-yellow) |
| D 6 | Led (down-green) |
| | Switching transistors: |
| Q 1–4 | 2N4920 |
| | Integrated circuits: |
| IC 1 & 2 | LM 311P |
| | Coils: |
| T 1 | T50 - 2 Toroid core 30 bifilar turns |
| | Switches: |
| Sw 1 | sp/st toggle |
| Sw 2 | dp/dt toggle |
| Sw 3 | dp/dt toggle center off |
| | Fuse: |
| F 1 | AGC 2 amp. |
| | Motor: |
| Motor | 317A122-8 24 V Globe Ind. Div. TRW. Dayton, Ohio |

The phase angle detector 3 is made up of the components bounded by the dotted area marked 3. The voltage comparitor is made up of the components bounded by the dotted area marked 4. The drive control selector is made up of the components bounded by the dotted area marked 16.

Thus, the mobile antenna circuit of the present invention provides an automatically resonant antenna for an RF signal which does not use a tuning device or an antenna tuner or tune an antenna that is resonant on an another frequency. The tuning element of the present invention is actually the radiating part of the antenna. The length of the antenna is adjusted to resonance, eliminating added radiation losses in coaxial feed line. The automatic resonating antenna of the present invention allows a skilled or unskilled radio operator to operate within a wide band of frequencies with the efficiency of an antenna tuned to a single frequency.

While a single embodiment of the invention has been described herein, many variations thereof will be apparent to those skilled in the art. Thus, it is intended that the scope of the invention be limited only by the claims which follow.

I claim:

1. A mobile antenna circuit for resonant transmitting from an RF signal source comprising:

an antenna having a base and at least first and second conductive sections, one of said first and second sections being extendable and retractable to lengthen and shorten said antenna;

a motor operatively connected to said first antenna section for extending and retracting said antenna in response to control signals thereto;

impedance matching circuit means coupling said RF signal source to the base of said antenna for matching the impedance thereof at a specified frequency;

control means connected to said motor to produce said control signals for extending and retracting said first antenna section so as to resonantly tune said antenna at said specified frequency;

a phase angle detector connected between said RF signal source and said impedance matching circuit means for developing a voltage differential proportional to the phase shift between RF line voltage and RF line current, said voltage differential being fed to said control means for producing said control signals to extend and retract said first antenna section to automatically tune said antenna at said specified frequency; and feed line selection means connected between said phase angle detector and said antenna base by which a specified length of feed line may be placed in series with said impedance matching circuit and in combination therewith create a phase shift between said RF line voltage and RF line current equal to one-quarter or any multiple of one-quarter wave length of feed line for said specified frequency.

2. The mobile antenna circuit of claim 1 in which said impedance matching circuit means is positionable to match the impedance of said RF signal source at a plurality of specified frequencies.

3. The mobile antenna of claim 2 in which said feed line selection means permits a plurality of lengths of feed line to be selected to correspond with said plurality of specified frequencies to create said one-quarter or any multiple of one-quarter wave lengths.

4. The mobile antenna circuit of claim 1 in which said impedance matching circuit means comprises an L network which creates a phase shift between said RF line voltage and RF line current, said phase shift being determined by the following formula:

$$\cos\beta = \sqrt{\frac{Z_2}{Z_1}}$$

where:

$\beta$=phase shift (degrees)

$Z_1$=impedance of RF signal source (ohms)

$Z_2$=impedance of antenna (ohms).

5. The mobile antenna circuit of claim 4 in which the length of said specified length of feed line placed in series with said impedance matching circuit is determined by the following formula:

$$L = \frac{L_f \times (90° - \beta)}{360°} + X\frac{L_f}{4}$$

where:

L=length of feed line $L_f$=one wave length of feed line for a specified frequency f $L_f/4$=one quarter wave length of feed line for a specified $\beta$=phase shift created by L network (degrees)

X=any whole number (or zero).

6. The mobile antenna circuit of claim 5 in which one wave length of feed line ($L_f$) is determined by the following formula:

$$L_f = \frac{984 \times V_f}{f}$$

where:

$V_f$=velocity factor of said feed line f=specified frequency (megahertz).

7. The mobile antenna circuit of claim 1 in which said antenna comprises a conductive base section and a conductive coil section above which are disposed said first and second sections, one of said first and second sections being telescopically extendable and retractable within the other to effect said lengthening and shortening of said antenna.

8. The mobile antenna circuit of claim 7 in which said first antenna section is operatively connected to said motor by a rod of nonconductive material passing through a hollow core of said coil section said rod being axially movable within said core in response to said control signals to effect said lengthening and shortening of said antenna.

9. The mobile antenna circuit of claim 8 in which said coil section is made of conductive wire wound on a tubular core of polycarbonate material and covered with polycarbonate material.

10. The mobile antenna circuit of claim 9 in which said nonconductive rod is of polytetra-fluro-ethylene, the upper end of said rod being attached to said antenna first section and the lower end thereof being mechanically attached to said motor by translation means by which rotation of said motor is translated to axial movement of said rod.

11. The mobile antenna circuit of claim 7 in which said coil section is tapped at a plurality of points allowing selected portions of said coil section to be electrically shorted to adapt said antenna for a plurality of specified frequencies.

12. The mobile antenna circuit of claim 11 including a second coil section electrically connectable between said first mentioned coil section and said first and second antenna sections to adapt said antenna for still another specified frequency.

* * * * *